US005701893A

United States Patent [19]

Kern et al.

[11] Patent Number: 5,701,893

[45] Date of Patent: Dec. 30, 1997

[54] DISPOSABLE FACE MASK

[75] Inventors: John J. Kern, Fullerton; Richard L. Stein, El Toro; J. Preston Wildrick, Riverside, all of Calif.

[73] Assignee: Survivair, Inc., Santa Ana, Calif.

[21] Appl. No.: 650,466

[22] Filed: May 20, 1996

[51] Int. Cl.[6] ..... A62B 7/10; A62B 18/08; A62B 18/02; A62B 23/02

[52] U.S. Cl. ..... 128/206.24; 128/206.19; 128/206.21; 128/207; 128/11

[58] Field of Search ..... 128/206.12, 206.13, 128/206.16, 206.17, 206.19, 206.21, 206.23, 206.24, 206.27, 207.11

[56] References Cited

U.S. PATENT DOCUMENTS

| | | | |
|---|---|---|---|
| 4,419,993 | 12/1983 | Petersen | 128/201.15 |
| 4,419,994 | 12/1983 | Hilton | 128/206.19 |
| 4,606,341 | 8/1986 | Hubbard et al. | 128/206.19 |
| 4,883,547 | 11/1989 | Japuntich | 156/73.4 |
| 5,553,608 | 9/1996 | Reese et al. | 128/206.24 |

FOREIGN PATENT DOCUMENTS 2103491 2/1983 United Kingdom .

*Primary Examiner*—V. Miller
*Assistant Examiner*—Robert N. Wieland
*Attorney, Agent, or Firm*—George F. Bethel; Patience K. Bethel

[57] ABSTRACT

A face mask for filtering airborne particles formed by an upper portion adapted for placement over a user's nasal area and a lower portion adapted for placement over a user's oral area. Ribs are formed ultrasonically extending along the length of the upper portion, and a pair of ears are formed at either end having openings therethrough to receive a plastic strap for passing through the openings of the ears to secure the mask to a user's face. The mask is formed by layers of plastic material including scrim and filtration material forming the upper and lower portions that have been ultrasonically bonded together. A process for making the mask includes providing plastic fabric layered materials that are ultrasonically welded with a plurality of ribs and slitting and sealing them to form two portions. The two portions are fed in overlying sandwiched relationship to each other and scored for the ears while at the same time welding them together to form an upper and lower portion of the mask.

21 Claims, 5 Drawing Sheets

FIG. 2
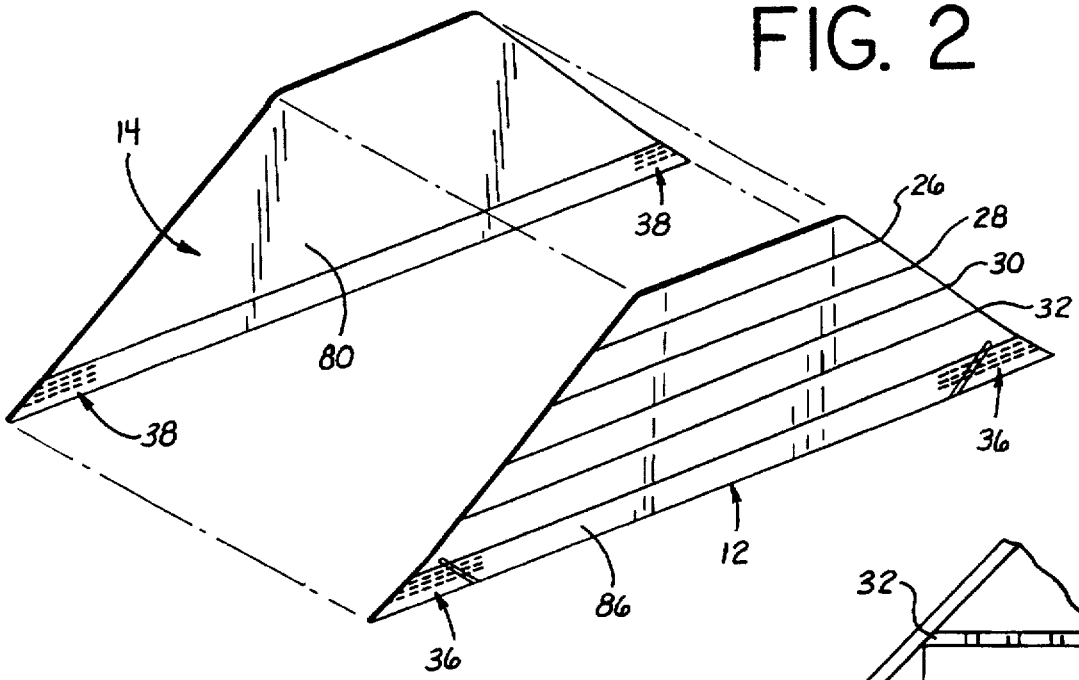
FIG. 4
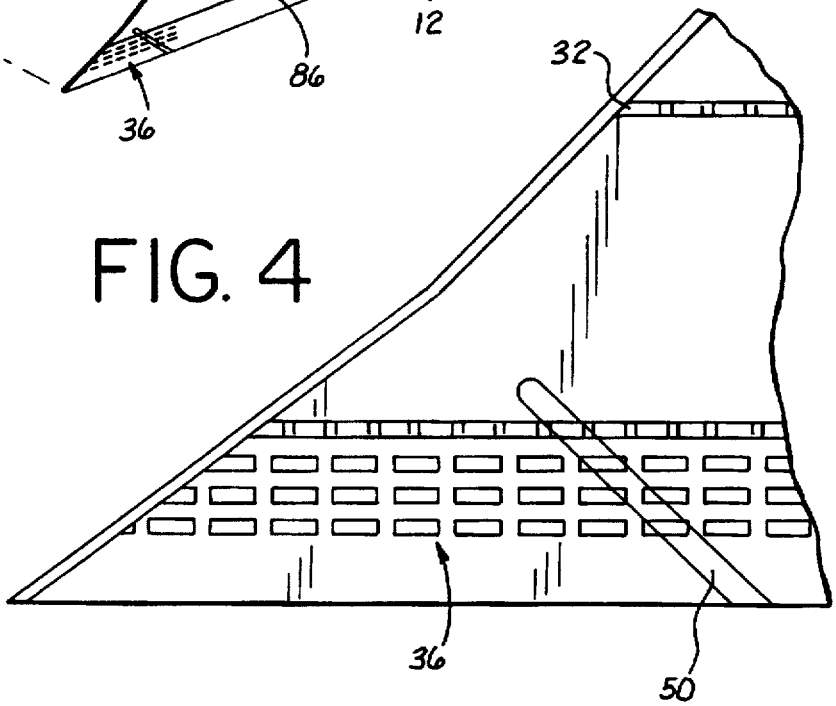
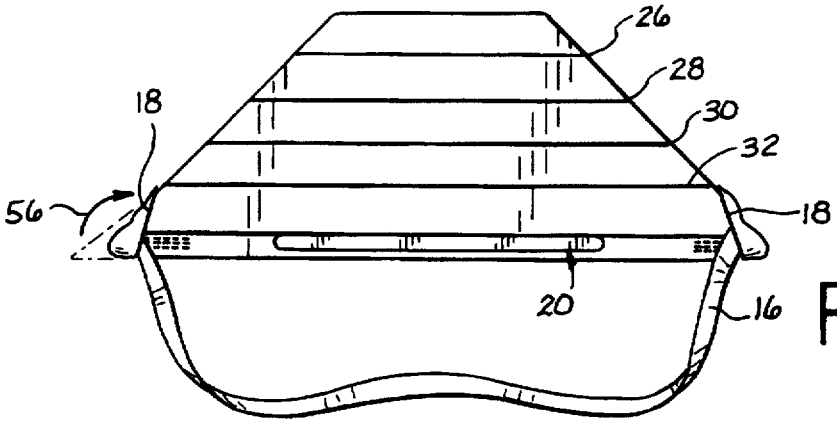
FIG. 5

DISPOSABLE FACE MASK

FIELD OF THE INVENTION

The field of this invention lies within the air purification art for breathing purposes. In particular, it resides within the area of oral/nasal masks which help to prevent the incursion of deleterious substances into a user's lungs. The mask has particular application for the prevention of aerosols and other airborne materials from being inhaled by a user. More particularly, it is such wherein it resides within the art of disposable masks that are used to prevent the incursion of airborne, deleterious substances and aerosols wherein the masks can be thrown away on a convenient and inexpensive basis.

BACKGROUND OF THE INVENTION AND PRIOR ART

The prior art with regard to masks involves a number of various masks including those having filter cartridges. Such filter cartridge masks have incorporated air purification cartridges that attach to a rubber or elastomeric oral/nasal face piece. The oral/nasal face pieces are such wherein they oftentimes have to be cleaned and are uncomfortable to wear for extended periods of time.

The oral/nasal masks which are made of rubber or an elastomer, and have cartridges, generally are formulated so that they provide for the removal and replacement of the cartridges as they become either clogged or no longer provide a sufficient filtration function. Such cartridges have been found to be expensive and the use and comfort of the user has been a detriment to their overall effectiveness in non-industrial, medical and lightweight uses.

In order to provide for a readily used lightweight mask, certain disposable mask designs have been used lately. Such masks are generally formed from a significantly highly concentrated woven and/or non-woven material. Such materials can form the basis of providing interwoven passages and interstices for the passage of air to a user. The masks and media within the masks have sufficient air passage capability such that ease of breath is accommodated while at the same time a significant entrapment of various airborne deleterious substances takes place. This is usually based on entrapment within a labyrinth of non-woven and/or woven fabric or scrim type fabrics with a non-woven material having multiple interstices. The interstices are calculated to allow for the passage of air while at the same time trapping deleterious airborne substances.

Such masks have incorporated an upper and lower portion which respectively fit over the nose and mouth area and/or can tuck under a person's chin or reside on a person's chin. It is preferable to have the masks easily secured by means of an elastomeric strap. The elastomeric straps are attached to the mask so that they are drawn backwardly to effectuate a tight seal over a user's nose and oral area. Such straps have been known to be used so that they pull up on the bottom portion and backwardly on the top portion to make a seal.

Also, in order to effectuate a tighter seal within the nasal area, a malleable metal piece or strip such as an aluminum strip is emplaced within the mask to allow it to be bent over a user's nose. This sealing capability of bending the mask over a user's nose creates a seal within the nasal area to help prevent the passage of undesirable airborne substances into the nasal area.

It has been known that in the usage of such masks, that they tend to collapse within the nasal area and do not hold their form over a user's oral/nasal passages. This invention is specifically directed toward providing for reinforcing or support ribs in order to allow the mask to conform in an open and expanded manner over a user's oral and nasal area. This helps to accommodate the breathing of a user while at the same time creating a volumetric space in the oral/nasal area for the maintenance of easy breathing.

The ribs of this particular mask which were not known in the prior art specifically permit an opening and support of the volumetric space of the mask to the extent where it is readily expanded for purposes of improved filtration. When the mask is not opened to its full extent, the cross sectional filtrational characteristics are not enhanced to the extent where they allow for the full use of the filtration media. With the ribs and the expanded volumetric space of this particular mask, the mask is an improvement with respect to prior art masks.

Another point of note is that the mask is sealed in the appropriate areas for helping to prevent the incursion of undesirable airborne substances. The configuration of the mask is such where the seal is maintained more readily for improved filtration.

Another feature is that the ribs in the configuration of the mask provide for lamination to prevent the layers from moving relative to each other. As can be appreciated, when the filtration media moves with respect to each other the quality of the filtration is diminished.

Some of the objects of this invention are to provide a mask with ribs which are designed to create a mask structure that: 1) Provides a face seal that can be maintained during facial movement, i.e. sustains the shape of the mask and thus reduces face seal slippage during use. This results in less face seal leakage. 2) Prevents collapse of the mask during use. Breathing resistance remains low for easy breathing, and filter efficiency against particulates remains high. 3) Creates and maintains an enlarged filtration area around the face. This increased surface area reduces the resistance to breathing. 4) Prevents relative migration and movement of the mask materials, thus enhancing the filtration characteristics of the filtering face mask.

The method of manufacture is particularly enhanced by virtue of the fact that the ribs are provided with an ultrasonic welding and bonding process. The ultrasonic welding and bonding process melts the layers of the soft plastic material and upon cooling is formed into a stiffened plastic rib. Furthermore, a sealing takes place in the ultrasonic welding process for providing the overall sealed configuration of the mask.

The method of manufacture is also enhanced by virtue of a process which scores the mask in an appropriate manner for ease of attachment of the elastomeric strap, by the bending over of ears for capturing the strap. Further to this extent, the manufacture of the mask is such wherein it receives four layers of material, scoring and forming the ribs of one pair of layers and slitting and welding the other, for a respective top and bottom portion of the mask. This scored and ribbed pair of layered materials are then brought together for ultrasonically welding them together to provide the upper and lower portions of the mask through a unique scoring and cutting process.

All of the features of this invention which are significant over the prior art will be detailed hereinafter in the specification.

SUMMARY OF THE INVENTION

Summarily stated, this invention provides for a new disposable oral/nasal mask to help to eliminate the breathing of deleterious airborne substances, and has an improved rib support structure with new and enhanced connection attachments for an elastomeric strap, while at the same time being made from a process which enhances the end product through a unique ultrasonic welding and scoring process.

More particularly, the invention incorporates ultrasonically welded ribs which have a densified structure across an upper portion of the mask. The ribbed portion is connected to a lower portion, the combination of which overlies the oral/nasal area in a well seated relationship.

A pair of ears or tabs on either side or end of the mask allows the attachment of an elastomeric material for seating the mask in relationship to a user's face. The ears or tabs, are enhanced by a particular scoring process which allows for easy assembly.

The ribs and the orientation of the ultrasonically welded seal helps to enhance the filtration ability of the mask. The configuration prevents for migration and movement of the materials and provides for a more durable and usable mask.

The net result is that the ribs provide a face seal that can be maintained during facial movement to sustain the shape of the mask. This reduces face seal slippage during use, resulting in less face seal leakage. The ribs prevent the collapse of the mask during use so that breathing resistance remains lower for easier breathing. Concomitantly filter efficiency against particulates remains high. An enlarged filtration area is maintained around the face to increase surface area to reduce resistance to breathing. At the same time the ribs prevent relative migration and movement of the mask to enhance the filtration characteristics of the mask.

The method of manufacture incorporates the utilization of four plies of material as will be detailed hereinafter. The four plies of material are respectively scored and ultrasonically welded in a unified step so that waste is substantially eliminated. The upper and lower respectively ribbed and non-ribbed portions are then overlaid and welded by a unique scoring and welding system. This welding system uses a Mylar film cushion to simultaneously seal and cut which enhances the overall product for a clean efficient and well manufactured disposable mask.

BRIEF DESCRIPTION OF THE DRAWINGS

FIG. 2 shows an exploded view of the mask components in their separated relationship prior to being ultrasonically bonded.

FIG. 4 shows a detailed portion of the mask encircled within circle 4 of FIG. 3.

FIG. 5 shows a plan view of the mask looking downwardly wherein the aspects of the folding of the ears or tabs are shown.

DESCRIPTION OF THE PREFERRED EMBODIMENTS

Figure 1:
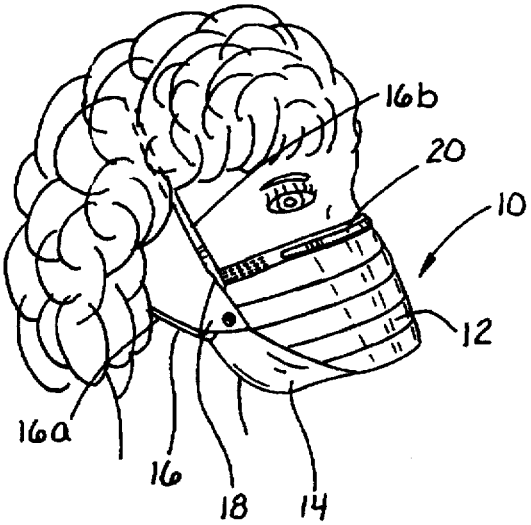
FIG. 1 shows a side perspective view of the mask of this invention being worn by a user.

Looking more particularly at the Figures with their respective descriptions, it can be seen that a mask 10 in FIG. 1 is shown. The mask 10 is shown on the face of a user. An upper, nasal, or ribbed portion 12 and a lower, oral or non-ribbed portion 14 are respectively ultrasonically bonded together in the manner to be described hereinafter and held in place.

An elastomeric band 16 is shown which is a double looped band forming portions **16*a* and 16*b* secured to the mask by ears or tabs 18** which shall be described further hereinafter.

The mask 10 is secured to a person's facial and nasal area more securely by a malleable nose bridge or strip 20 which will be detailed in the manner described hereinafter. The malleable nose bridge 20 conforms to the user's nose and can be bent and formed in such a manner as to provide for conformation of the mask to a user's nose.

Figure 6A:
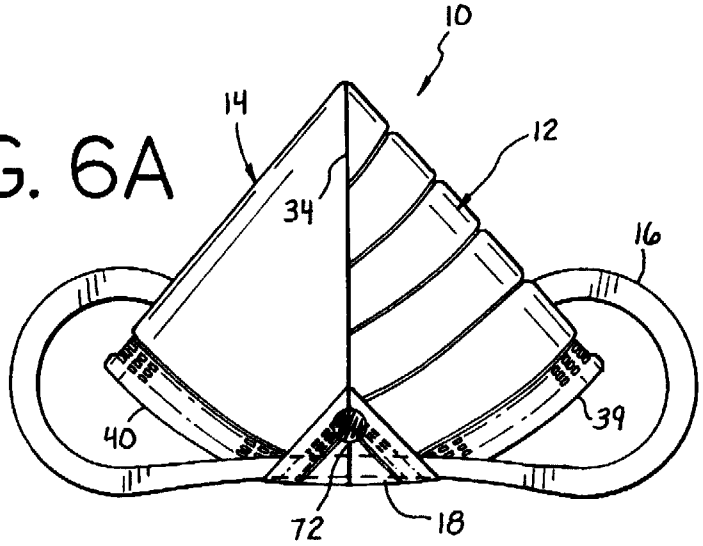
FIG. 6A shows the mask with the ears or tabs folded over securing an elastomeric band thereto.
Figure 6:
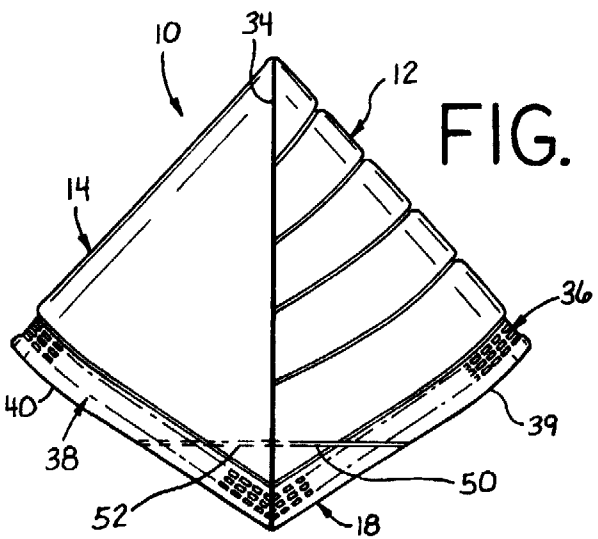
FIG. 6 shows the mask in its expanded relationship before the ears or tabs are folded over.

Looking more particularly at FIGS. 6 and 6A, the mask 10 can be seen with the elastic band 16 shown in FIG. 6A after it has been attached to the mask 10. The mask is shown in somewhat of an open condition in which it would normally be placed over a user's face, and providing a significant volumetric space.

Figure 4A:
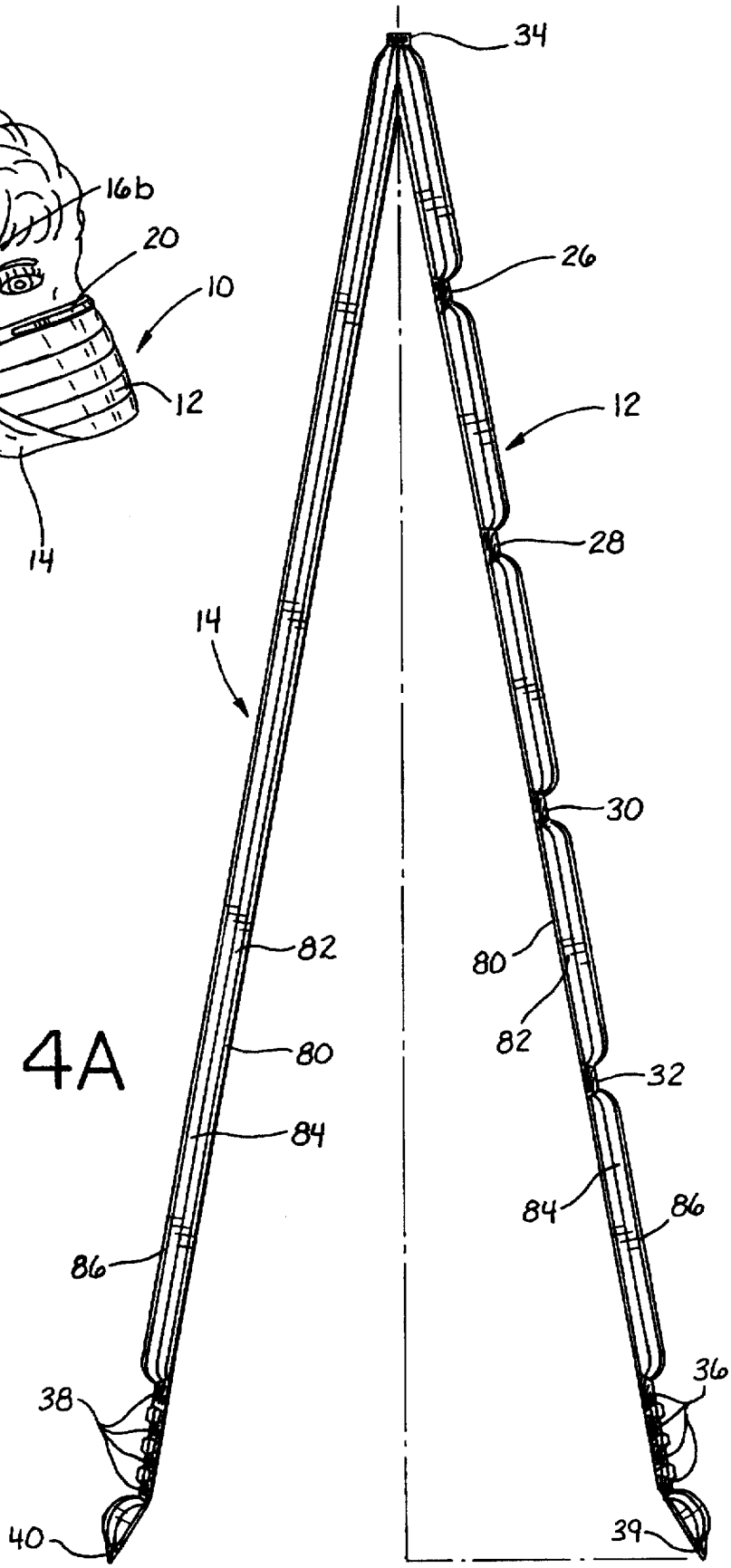
FIG. 4A shows a detailed midline cross sectional view of the ribs and mask upper and lower portions of this invention, along lines 4A—4A of FIG. 3.

Looking more particularly at FIG. 4A, the detailed mask portions are shown in greater detail. In particular, a pair of layers forming the upper ribbed or nasal portion 12 and the lower, non-ribbed or oral portion 14 are shown. These particular portions 12 and 14 respectively are formed in such a manner by the ultrasonic welding process as detailed hereinafter as to effectuate a configuration in the manner established in the Figures.

Looking more particularly at the upper portion 12 it can be seen that layers form a composite, or grouping of materials that form the upper portion 12. These layers have been welded ultrasonically at elongated weld points 26, 28, 30, and 32 to provide a plurality of longitudinal elongated ribs along the length of the upper portion 12. These ribs 26 through 32 are formed by an ultrasonic welding process which melts the plastic material into a gel which later cools into the ribs.

Ribs 26 through 32 are in a longitudinal direction across the face of the upper or nasal portion 12. The ribs as shown are generally in parallel relationship. However, they can be elongated waved ribs of any suitable configuration such as a sinusoidal line, wavy line, stepped line or other configuration so long as they extend in a longitudinal relationship to provide an opening and the expansion of the volumetric space of the mask.

When referring to the longitudinal or elongated portion of the mask, reference is made to the mask direction extending from one side to the other in the same general planar direction as the periphery of the opening of the mask. In other words longitudinal means in the direction across a user's face.

At the extremities of the layers 12 and 14, or outer periphery, a seal or weldment 34 is shown. The seal or weldment 34 is such that it provides for a seal at the end of the mask and around the periphery as will be detailed in the process hereinafter.

At the upper portion of the mask which is worn adjacent a user's face are a series of seals. The seals provide a barrier to prevent the migration of airborne substances through the layers of material on a cross sectional basis through the interstices on a lateral basis. These sealed portions have been grouped together as sealed portions 36 that have a waffle like configuration as can be seen in the views of FIGS. 2, 3, 4, 6, and 6A.

A second series of seals are provided in a waffle like pattern namely seals 38 which are weldments in the lower layer or portion 14. Also, at the interfacing edge portion of the mask adjacent a user's face, seals 39 and 40 are shown which form a seal. The seals 39 and 40 effect a sealing at the edges, and also prevent fraying and migration of airborne media. This is analogous to the seal 34 which is shown forming the peripheral seal.

Looking more specifically at FIG. 2, it can be seen that the two particular portions of the mask are shown constituting the upper portion 12 and lower portion 14 which are later sandwiched together and bonded at their edges in the manner to be described in the process hereinafter. This bonding brings the edges of the layers 12 and 14 together and causes them to be formed with the weldment 34 that circumscribes the mask.

Looking more particularly at detailed FIG. 4, it can be seen that a scoring mark or indentation 50 has been shown. This scoring mark or indentation 50 is used to form the ears or tabs 18 at either end of the mask 10. The ends of the mask denote those ends toward the longitudinal extremities or proximate either side of a user's face. This scoring mark 50 is only scored in the upper portion 12. This is due to the fact that when it is joined to the lower portion 14, and folded to form the ear 18, a continuation thereof seen as continuation 52 extends in the fold direction of the ear 18. Thus, it is not necessary to score both the upper portion 12 and the lower portion 14. This scoring 50 can be by the rollers as detailed hereinafter.

Looking more particularly at FIG. 5, it can be seen that the ears or tabs 18 have been folded upwardly along the scoring line 50 and extension 52 in order to capture the elastic band 16. This is shown in detail in FIG. 5 wherein the process of folding the ears 18 upwardly in the direction of arrow 56 shows the ear from the corner portion formed as shown in FIG. 4 being folded into the ear or tab 18. This upwardly folding action in the direction of arrow 56 along the score line 50 easily provides for a bend or fold along line 50 and the extension 52 of the bottom portion 14 when welded thereto.

In order to provide for the nose bridge or strip 20 as previously set forth in FIG. 1, a malleable strip of aluminum that is relatively soft and conformable to a user's nose is bonded to the upper portion 12. A vinyl film is placed over the strip 20.

Figure 3:
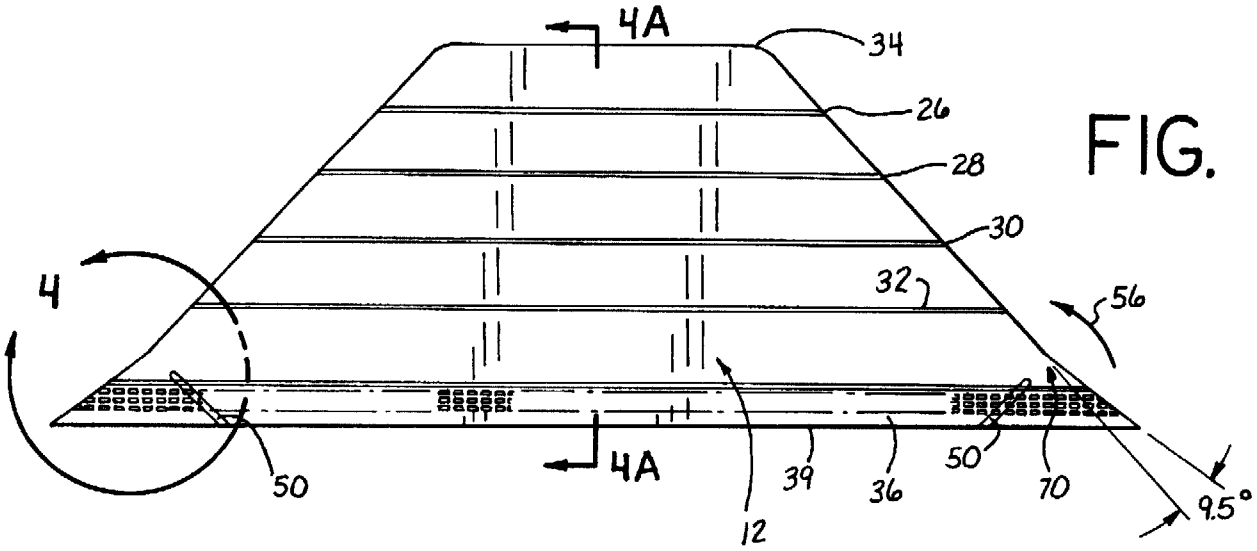
FIG. 3 shows a top plan view of the top portion of the mask looking downwardly thereon.

Looking more particularly at FIG. 3, it can be seen that the line on the edge of the top and bottom portions 12 and 14 of the mask extends outwardly at the ear portions 18 at an angle of approximately 9.5°. In effect, a break point at portion 70 is shown wherein the general linear direction of the weldment 34 or interface between the upper and lower portions 12 and 14 are seen stopping at break point 70 to extend at an angle outwardly away from the line of weldment 34 at 9.5°. The 9.5° value as to the angular outward flaring is not an absolute criteria but is helpful in establishing a range. Generally, it has been found that an accommodating range by increasing the angle to allow the outward flare, effects a bend along line 50 and extending line 52. This bend to form the ears 18 can be effectuated with any suitable angle which bends outwardly to some appreciable degree as to the line of the weld 34.

The ears 18, it can be seen, when formed along lines 50 and 52 are bent upwardly and then spot welded in place by means of an ultrasonic weld 72. The ultrasonic weld 72 is such wherein it can be provided by any ultrasonic welding process so as to melt the plastic material and allow it to form a tab or weldment point, and securement of the ears 18. This allows free travel of the elastic band 16 through the ear openings between the edge of the field and the weldment 72.

Figure 7:
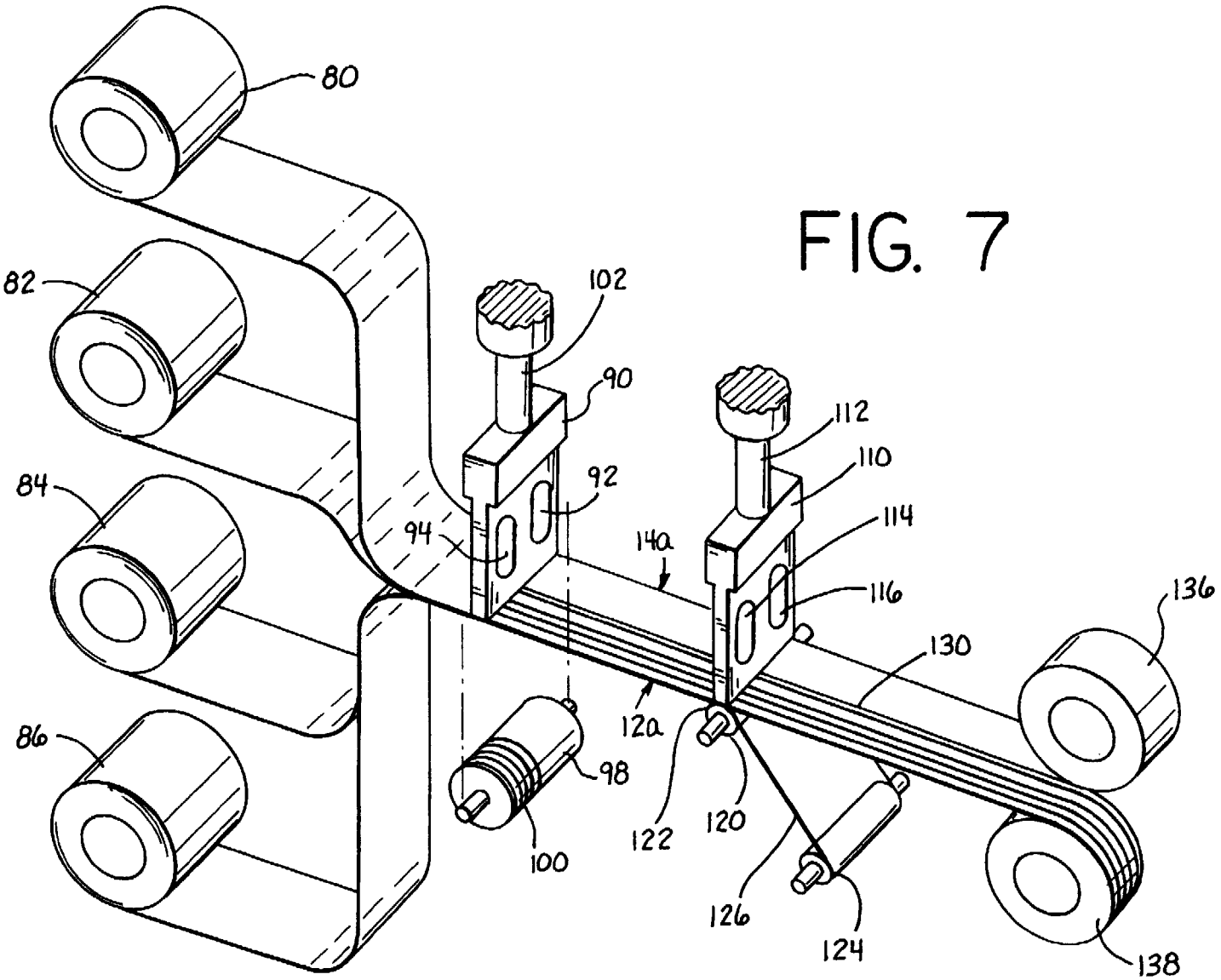
FIG. 7 shows the process of manufacture of the mask of this invention and the various materials coming together to be ultrasonically welded and slit to form a pair of layered materials for the upper and lower portions.
Figure 8:
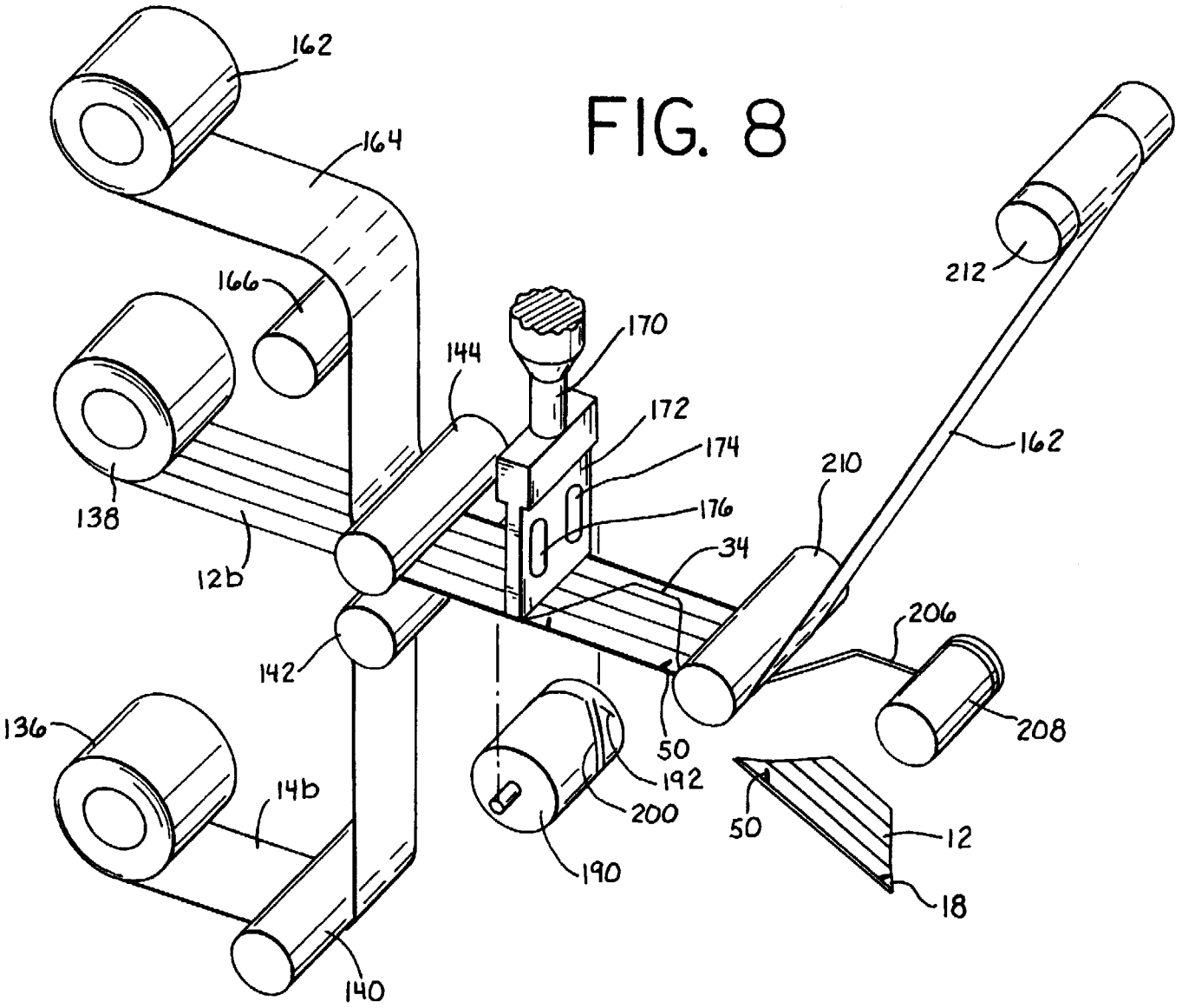
FIG. 8 shows the final manufacturing process with the welding together of the upper and lower portions of the mask and the final separation from the web material.

Looking more particularly at FIGS. 7 and 8, in conjunction with the mask and its configuration, it can be seen that the process of manufacturing has been detailed. Also the respective portions of the mask have been shown for greater understanding.

Each portion of the mask, namely the upper or nasal portion 12 and lower or oral portion 14 are conformed of the same mask material. The portions comprise inner and out portions that are respectively in relationship to facial contact.

Looking more particularly at FIG. 7, it can be seen that rolls of material are shown being fed into the process. A first roll in the form of scrim fabric material 80 is shown. This scrim fabric material 80 is the material which contacts the face and can be seen in FIGS. 2 and 4A. A stiffening scrim material 82 is shown in the process and in FIG. 4A. The stiffening scrim material 82 provides stiffening.

A filter media 84 is shown which is sandwiched in between the respective layers.

Finally, an outer scrim material 86 is shown which is the outer scrim material that can be shown in FIGS. 2 and 4A forming the outer surface of the layers.

Now looking more particularly at the layers, it can be seen that the inner scrim fabric 80 is fed into the process. The inner scrim is of a lighter and softer material. It is a spun bonded polypropylene that has low resistance to air flow. Fundamentally, it is a non-woven polypropylene fabric. Other plastics can be utilized in the process so long as they have the same melt capacity to be ultrasonically bonded and form the protective nature of the inner scrim while at the same time maintaining sufficient softness to be in contact against a user's face.

Ease of ultrasonic welding of a plastic increases with increase in rigidity, modulus of elasticity, coefficient of friction, and thermal conductivity. It increases as well with a decrease in melt temperature, density, and specific heat.

Hygroscopic materials, crystalline materials, as well as nylon, polyester and acetal materials should be avoided.

More favorable materials are amorphous polymers such as polystyrene (PS), acrylonitrile-butadiene-styrene (ABS), and polycarbonates since they have a broad lower melt temperature range. Other examples include among others, polyethylene, polystyrene, polybutylene terephthalate (PBT), and styrene-acrylonitrile.

When dissimilar plastics are to be welded, it is best to have the melt temperature of the two material within 25° F. of each other.

With the foregoing in mind a selection of materials can be made to provide the various filtration, protection and stiffening requirements aside from the polypropylene materials, fabrics and scrim.

The stiffening scrim material 82 is a spun bonded polypropylene having a larger fiber diameter for greater stiffness. The orientation can be seen in FIG. 4A. The stiffening scrim 82 is of such a nature that it might be too stiff against a user's face and that is the reason why the spun bonded polypropylene inner scrim material is utilized.

The main filter material shown in FIG. 4A in the form of filter material 84 is provided as a melt blown polypropylene. It has excellent filtration with minimum resistance to air flow through its interstices. These interstices are very small and pass through extremely small diameter tight fibers.

Finally, an outer scrim 86 is used for the outer surface of the mask. This is seen in FIGS. 2 and 4A. This outer scrim fabric material is the same as the inner scrim material but heavier. It serves to protect the filter media 84 that is covered up.

These four respective layers 80 through 86 are passed toward an ultrasonic welding horn. The ultrasonic welding horn welds and forms the embossing of the ribs 26 through 32 as well as the waffle pattern 36 on the upper portion 12. It also forms the waffle pattern 38 on the lower portion 14.

For purposes of description of the process, the upper 12 and lower 14 portion of the mask 10 have been designated as to their composite sandwiched portions as 12*a* and 14*a* in the form of the welded strips after passing through an ultrasonic horn 90 prior to being formed as the final mask.

The ultrasonic horn 90 is formed of titanium with a tungsten carbide face and with cutout portions 92 and 94. The cutout portions 92 and 94 allow the horn to be tuned so that it does not create a situation wherein the ultrasonics are not transmitted properly to the media layers 80 through 86 which constitutes the layered or sandwiched strips 12*a* and 14*a*.

In order to respectively provide for the ribs 26 through 32 and the waffle patterns 36 and 38, a roller 98 is provided. The roller is in direct contact on the underside of the layers or strips 12*a* and 14*a*. The roller 98 is provided with ribs or rings 100 which create the welded ribs 26 through 32 and the waffle pattern. The roller 98 moves at the same speed as the material 12*a* and 14*a* so that a consistent movement and non-tearing welding function takes place.

The roller 98 is fixed as to its placement. Adjustment of the contact of the roller 98 against the layered strip of materials 12*a* and 14*a* is by means of raising and lowering the horn 90. This is by means of a fluidic or pneumatic cylinder connected to a support 102. Support 102 can be raised and lowered to provide contact against the fixed relationship of the roller 98. The foregoing provides the ultrasonic welding against the roller 98 with the raised rings or circular portions or ribs 100.

In order to split and seal the edges and the central portion of the layered strip of materials 12*a* and 14*a*, a second ultrasonic horn 110 is shown connected to a cylinder or support 112 which can raise and lower the horn 110. The horn 110 like horn 90 has openings or slots 114 and 116 that allow tuning of the ultrasonic horn. The horn 90 can also be made of titanium and provided with a tungsten carbide face.

A slitter wheel 120 is shown having cutters 122 for forming an edge which can trim the edge of the material 12*a* and 14*a*. The excess trimmed waste material is wound on a roller 124 in the form of the waste or trim 126 as shown on either edge.

The ultrasonic horn 110 also serves the function of providing a slit with the roller 120 along line 130 of the two respective layers 12*a* and 14*a* and welding the edges to form weldments 39 and 40. The two webs, layers or sandwiches 12*a* and 14*a* can then be rolled up to provide the material on an upper web of material or roll 136 and a lower web of material or roll 138. They respectively form the portions 14 and 12 of the mask. These respective portions 14 and 12 have been derived as can be seen by the material being brought together to form the layers 12*a* and 14*a* that are respectively bonded with the form of the ribs, and slit and sealed with the ultrasonic welding as previously set forth.

In order to further process the layers 12*a* and 14*a* that have been wound on rolls 136 and 138, it should be observed that in FIG. 8 the rolls in the form of the top web strip sandwich or layered material, that forms the upper or nasal portion 12 has been shown as roll or web 12*b*. This sandwich or layer 12*b* derived from roll 138 is rolled outwardly. It is then fed for mating with material 14*b* on the roll 136 which forms the bottom or oral portion 14 of the mask. The respective rolls 136 and 138 that allow webs 12*b* and 14*b* to be drawn are passed over respective rolls or other feeding means 140, 142, and 144 to be fed as a uniform overlying pair of layers or sandwiches 12*b* and 14*b*.

A 0.003 mil thick polyester plastic film on roll 162 is shown feeding polyester film 164 over a feed roll 166. This is fed on top of the layer 12*b* which overlies layer 14*b*. It serves to provide for a cushioning during the process for scoring and cutting.

A pneumatic actuator 170 supporting an ultrasonic welding horn 172 is shown. The horn 172 having tuning openings 174 and 176 is analogous to the horns 90 and 110. The pneumatic or fluidic connected support or actuator 170 analogous to the supports 102 and 112 allows for adjustment of the upward and downward movement of the horn 172 against a fixed scoring drum 190.

The fixed scoring drum has scoring ribs 192 and a cutting surface 200 which cut the profile of the mask portion while at the same time providing a surface for welding the sealed weld 34 which extends around the edge of the mask. The respective layers 12*b* and 14*b* are supported in part by the film 162. The film 162 provides for a cushion and abrasion protection against the surface of the horn 172 so that the scoring ribs 192 of the fixed drum 190 are cushioned and do not abrasively engage the surface of the bottom of the horn 172. This allows for improved life of the horn, even though it is of a tungsten carbide material or can be made of titanium with a tungsten carbide face. If the film 162 is not used, it has been found that greater wear on the horn 172 takes place. Also, a neat trim is not created as effectively by the scoring ribs 192.

After the scoring ribs 192 and the cutting profile provided by the cutting surface 200 cuts the material and forms the weldment 34 around the edge thereof, the bonded and welded mask portions 12 and 14 respectively exit the process. The waste material that has been cut in the form of material 206 is wound around a drum 208.

The Mylar film 162 is fed upwardly over a feed roller 210 and wrapped around a roller 212.

With the foregoing in mind, it can be seen that the edge weldment and seal 34 is provided by the horn 172 against the roller 190 as well as cutting the configuration. Additionally, the marking or scoring line 50 is provided to allow for the configuration of the ears as previously mentioned. Thus, the entire process is enhanced and effectuated by the foregoing to create a bonded mask having portions 12 and 14 with reinforced ribs. It has been scored for folding to receive an elastic strap and by then folding over the ears, and welding the button or weldment 72 to secure the elastic strap 16 in the space within the ears 18.

From the foregoing, it can be seen that the mask 10 is created through the foregoing process to provide not only a unique mask and supporting ribs but a configuration which is readily adapted for conformation in forming a mask.

This invention should be read broadly and interpreted in light of its improvements set forth in the specification and as claimed hereinafter.

We claim:

1. A face mask for filtering airborne materials comprising:

an upper portion adapted for placement generally over a user's nasal area;

a lower portion adapted for placement generally over a user's oral area;

ribs extending longitudinally of said mask along said upper portion;

a pair of ears at either end of the mask having openings therethrough;

a strap means for passing through the openings of said ears to secure the mask to a user's face;

layers of plastic material forming the upper and lower portions that have been ultrasonically bonded together, and said ribs being formed by ultrasonically bonding said layers of plastic material through their cross-section to a thickness less than the combined layers of plastic material.

2. The mask as claimed in claim 1 further comprising:

a series of multiple ultrasonic weldments on the upper portion and lower portion of the mask proximate the opening of the mask.

3. The mask as claimed in claim 1 further comprising:

an ultrasonically welded bead along the exposed edges of said mask proximate a user's face and an ultrasonically welded seal connecting the upper and lower portions of the mask.

4. The mask as claimed in claim 1 further comprising:

a malleable strip on the upper portion of said mask proximate to where a user's nose would be for conforming the mask to a user's nose.

5. The mask as claimed in claim 1 further comprising:

a scoring line on either end of said mask along which the ears are folded at least in part.

6. The mask as claimed in claim 5 further comprising:

ears that have been folded over at the ends and ultrasonically welded to the mask to form the openings for said strap means passing therethrough.

7. The mask as claimed in claim 6 wherein:

said mask is formed with an inner and outer scrim material; and, at least one filtration material between said scrim materials.

8. A mask for filtering airborne particles having a plurality of plastic layers comprising:

an upper portion adapted for placement generally over a user's nasal area;

a lower portion adapted for placement generally over a user's oral area;

a plurality of ribs extending across a line extending generally from where a user's nose would be ultrasonically formed by ultrasonic welding, and wherein said ribs are formed with respect to the adjacent cross-section of the plurality of plastic layers less than the thickness of the cross-section of the plurality of plastic layers.

9. The mask as claimed in claim 8 further comprising:

said upper portion and lower portion both formed from a plurality of plastic fabric materials; and, wherein the upper portion having said ribs is formed with said ribs by ultrasonically melting the plastic material to form said ribs.

10. The mask as claimed in claim 9 further comprising:

an ultrasonically welded seal around the peripheral portion of said mask and an ultrasonically welded bead portion exposed to a user's face.

11. The mask as claimed in claim 10 further comprising:

a pair of ears at either end of said mask formed by folding over the edges and securing them to the mask; and, a strap means for attaching the mask to a user's face extending between the ears.

12. The mask as claimed in claim 11 further comprising:

a malleable metallic strip on the upper portion of said mask extending proximate to where a user's nose would be placed for conforming the mask over a user's nose.

13. The mask as claimed in claim 12 further comprising:

said plastic fabric materials forming the upper portion and lower portion of said mask comprise a scrim material on either surface sandwiching a filtration material.

14. A mask for filtering airborne particles comprising:

an upper portion for passing over a user's general nasal area;

a lower portion for passing over a user's general oral area;

an ultrasonic weld bonding said upper and lower portions together;

a pair of scoring lines distal from each other and proximate the ends of said mask that have been impressed into at least said upper portion or lower portion;

ears folded at least partially along said scoring lines over and onto the mask body and secured thereto; and, strap means for passing through said ears for securing the mask to a user's head.

15. The mask as claimed in claim 14 further comprising;

ribs ultrasonically formed in the upper portion and extending across a line extending generally from the direction of the nose of a user, and wherein said ribs are formed into said upper portion equal to or less than the cross-sectional thickness of said upper portion.

16. The mask as claimed in claim 15 further comprising:

an ultrasonically sealed edge at the open portion of said mask exposed to a user's face and around the edge of the mask where the upper and lower portions are joined.

17. A process for making a mask comprising:

providing a plurality of layers of plastic fabric materials in overlying relationship to each other;

slitting and sealing said plurality of plastic materials to form two sandwiched portions thereof;

feeding said two sandwiched portions of material in overlying relationship to each other;

welding the two sandwiched portions together to form an upper and lower portion of the mask by means of an ultrasonic welding horn overlying a cylinder having cutting scoring lines and welding lines thereon; and, providing a layer of plastic material between said welding horn and said sandwiched portions, which is not welded to said upper and lower portions.

18. The method as claimed in claim 17 wherein:

said layer of plastic material is a polyester film.

19. The method as claimed in claim 18 further comprising:

ultrasonically welding ribs along a portion of the mask forming the upper portion.

20. The method as claimed in claim 18 further comprising:

forming scoring lines within the upper portion of said mask; and, forming ears along said scoring lines in the upper portion of said mask.

21. The method as claimed in claim 20 further comprising:

securing said ears by ultrasonically welding said ears to the mask after passing a strap means between said ears.

* * * * *